US005727891A

United States Patent [19]

Lang

[11] Patent Number: 5,727,891

[45] Date of Patent: Mar. 17, 1998

[54] OINTMENT DISPENSER WITH KICK-START MECHANISM

[75] Inventor: Frank J. Lang, Warrenville, Ill.

[73] Assignee: Federal Package Network, Inc., Chaska, Minn.

[21] Appl. No.: 675,209

[22] Filed: Jun. 17, 1996

[51] Int. Cl.[6] ..... A45D 40/06

[52] U.S. Cl. ..... 401/87; 401/68; 401/69; 401/75; 401/175

[58] Field of Search ..... 401/68, 69, 75, 401/79, 87, 172, 175

[56] References Cited

U.S. PATENT DOCUMENTS

| | | |
|---|---|---|
| 416,659 | 12/1889 | Wells et al. . |
| 955,617 | 4/1910 | Tucker . |
| 1,781,852 | 11/1930 | Lyhne . |
| 1,783,754 | 12/1930 | Stepelton . |
| 2,101,132 | 12/1937 | Daly et al. . |
| 2,368,997 | 2/1945 | Mitchell . |
| 2,609,092 | 9/1952 | Braselton . |
| 2,704,153 | 3/1955 | Florman . |
| 2,844,893 | 7/1958 | Keller . |
| 2,872,034 | 2/1959 | Harris . |
| 2,917,765 | 12/1959 | Jakubowski . |
| 3,008,172 | 11/1961 | Thompson . |
| 3,083,823 | 4/1963 | Metreaud . |
| 3,212,120 | 10/1965 | Gentile . |
| 3,235,900 | 2/1966 | Klassen . |
| 3,264,676 | 8/1966 | Schwartzman . |
| 3,281,887 | 11/1966 | Raffe . |
| 3,429,643 | 2/1969 | Seaver . |
| 3,616,970 | 11/1971 | Baumann . |
| 3,917,417 | 11/1975 | Lang . |
| 4,363,560 | 12/1982 | Gentile . |
| 4,422,545 | 12/1983 | Kadoory . |
| 4,579,134 | 4/1986 | Moore . |
| 5,000,600 | 3/1991 | Cardia . |
| 5,234,136 | 8/1993 | Kopis . |
| 5,340,225 | 8/1994 | Chevassus . |

FOREIGN PATENT DOCUMENTS

| | | |
|---|---|---|
| 470276 | 12/1950 | Canada . |
| 1019835 | 1/1953 | France . |
| 1144093 | 10/1957 | France . |
| 2556941 | 6/1985 | France . |
| 3118893 | 11/1982 | Germany . |
| WO 86/00203 | 1/1986 | Italy . |
| 332593 | 9/1989 | Italy . |
| 387213 | 9/1990 | Italy . |
| 246657 | 2/1926 | United Kingdom . |

*Primary Examiner*—Steven A. Bratlie
*Attorney, Agent, or Firm*—Breiner & Breiner

[57] ABSTRACT

The dispenser for lip-salve or similar ointment includes a tube, an elevator axially movable within the tube for expelling the ointment, and a screw rotatable within the cylinder and interacting with the elevator for moving the elevator within the tube. The internal threads on the elevator interact with the external threads on the screw when the screw is rotated. The elevator is generally cup-shaped, and is arranged to prevent relative rotation between the elevator and the tube. A knob is integral with the screw and external of the tube, and a groove in the knob and a collar in the tube permit relative rotation of the knob and screw with the tube but prevents relative axial movement between the tube and the screw. At least one inclined plane is on the bottom of the cup-shaped elevator and interacts with at least one inclined plane on the knob, within the tube, whereby when turning the knob, the inclined planes on the knob forceably push the inclined planes on the elevator axially within the tube. The interacting external threads on the screw and the internal threads on the elevator move the elevator axially within the tube after the inclined planes on the elevator move out of contact with the inclined planes on the knob.

8 Claims, 1 Drawing Sheet

OINTMENT DISPENSER WITH KICK-START MECHANISM

BACKGROUND OF THE INVENTION

The present invention relates to coating implements for dispensing a supply of semi-solid materials, such as a gel or cream or salve or the like, wherein the material, after being dispensed, is applied by rubbing contact with the surface on which it is to be applied.

It more particularly relates to tubes such as those used to apply lip balm or lip salve for protection against sunburn or chapped lips or the like, wherein the material to be applied is ejected from the container by a propel action and returned to the container by a repel action, particularly by twisting a portion of the container.

Such implements are generally classified in the U.S. Patent Office in Class 409/49 etc., and more particularly in subclasses 68 and 72.

Illustrative of the well-known devices of those shown in the U.S. patents issued to Lang are U.S. Pat. Nos. 3,917,417; Landon 3,335,854; Seaver 3,429,643; Gentile 4,363,560; Harris 2,872,034 and Lyhne 1,708,852.

Some of the earliest of these types of dispensers go back to the early part of the century, and Recker 1,499,784 is illustrative. As shown in Recker, a tube contains the material to be dispensed, and a screw mechanism is placed within the tube. An elevator, slidably mounted within the tube and actuated by the screw, rides up and down within the tube when the screw (or a knob at the end thereof) is turned.

The material to be dispensed is placed within the tube, surrounding the screw and on top of the elevator, and thereafter a closure cap is placed over the open end.

By turning the knob and screw, the elevator is made to rise, forcing the material from the top of the tube after the cap is removed. When it is desired to retract the material within the tube, the screw is rotated in the opposite direction, withdrawing the elevator and pulling the material back into the tube.

The prior art devices, in many instances, operate with some difficulty because the semi-fluid material is generally placed within the tube on top of the elevator while it is hot and semi-fluid; and when the material subsequently cools, it tends to stick to the inside wall of the container. This sometimes makes it difficult to actuate the propelling mechanism to raise the elevator, because the material is stuck tightly to the sides of the tube, and quite often the screw-mechanism which creates the upward movement of the elevator is stripped from the elevator.

Previous attempts to achieve a rapid travel of the elevator were unsuccessful because with the product adhering to the sidewalls of the tube and with the higher pitch of the screw the elevator jumped the threads of the screw rather than propel the product.

Therefore, it is an object of the present invention to provide a dispensing mechanism whereby the initial twisting action of the screw within the tube also causes a movement of the elevator independently of the screw-action, thus "breaking loose" the semi-solid material from the inside walls of the tube, so that thereafter the twisting action of the screw within the elevator easily continues the expulsion of the material from the tube without damaging the screw or the elevator or negatively affecting the movement of the material upwardly and outwardly from the tube.

Another object of the present invention is to provide a "kick-start" or "jump-start" arrangement between the base of the screw and the bottom of the elevator, whereby forcibly to move the elevator upwardly and outwardly and thus pushing the contents along with it, without relying upon the interaction of the screw and the elevator.

Thus a further object of the present invention is to provide a tube construction which insures the propelling of the contents upwardly and outwardly from the tube.

Yet a further object of the present invention is to provide a screw and elevator combination which insures the propulsion of the content from a very small diameter tube.

SUMMARY OF THE INVENTION

To accomplish the aforesaid objects, there is provided a salve-dispenser which in its overall dimensions may be 3" long and ½" in diameter. The central portion, which is about 2' long, is a hollow cylinder or tube having relatively thin walls made of polypropylene. A cap about ¾" long fits over the upper end of the tube with a snap-groove ring arrangement.

At the bottom of the tube, a knob which is about ½" long, consists of a knob and a screw which extends upwardly from the knob within the body or cylinder.

A collar or rim at the bottom of the tube mates within a circumferential groove formed at the top of the knob and the base of the screw, and this permits the knob and screw to turn within the cylinder.

An elevator, having female screw arrangements which mate with the aforesaid screw, includes a cup-like bottom portion, and around the rim of the cup-like portion of the elevator, a bead is formed so as to fit tightly against the inner-walls of the cylinder.

The elevator has a plurality of axially-extending grooves, and the inner wall of the cylinder has a plurality of mating axially-extending ribs which fit within the grooves in the elevator and prevent the elevator from turning when the knob and screw are turned.

The relative turning between knob/screw and elevator causes the elevator to rise upwardly within the cylinder.

After the cylinder/knob/screw and elevator are assembled, the semi-solid material to be dispensed from the cylinder is poured into the tube (the material being hot enough so that it flows), but when it subsequently cools it becomes the semi-solid, salve-like material.

When the knob and screw are turned and the elevator rises, it lifts the semi-solid material within the tube upwardly and outwardly through the opening at the top of the tube, and thus dispensing the contents where it can be rubbed or placed against the surface which is intended to receive the semi-solid material.

Similar construction has been shown in prior art and particularly the inventor's earlier patent, Lang U.S. Pat. No. 3,917,417.

The improvement of the present invention includes the provision of the pair of feet which extends downwardly from the underside of the cup-like portion of the elevator, and the further provision of a pair of buttons or "kickers" which contact the feet beneath the elevator and force the elevator upwardly, independently of any screw and elevator action which also causes the material to be propelled upwardly at the initial turning of the bench.

As aforesaid, the splines or v-shaped ribs on the interior wall of the cylinder or body prevent the elevator from turning with rotation of the screw.

Because the elevator is made of soft polyethylene, it creates a seal against the inner wall and splines of the polypropylene tube, and this is uniquely effective when the semi-solid material to be contained within the tube is done by the "hot fill" method.

The product adheres to the inside wall of the container and requires a higher force than is usually needed to permit the material to slide upwardly within the tube as in the case of a generally standard propel and repel action.

A usual screw and pitch arrangement has eight threads per inch, but in the present invention a pitch of four rotations per inch is used, and this higher rate of pitch on the rapid travel of the screw and elevator exerts more outward pressure on the threads of the elevator than in previous devices. Without the device of the present invention, the higher outward pressure at the initial "break" or release of the product from the sidewalls has in the past resulted in elevator expansion, whereby it jumps the threads rather than propelling the product upwardly.

Thus the "kickers" of the present invention overcome the initial breaking force, and once that has taken place, the interaction of the screw and elevator successfully works to remove the material and propel it outwardly from the small diameter body.

With the above and other objects in view, further information and a better understanding of the present invention may be achieved by referring to the following detailed description:

BRIEF DESCRIPTION OF THE DRAWINGS

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts.

DESCRIPTION OF THE PREFERRED EMBODIMENT

Figure 1:
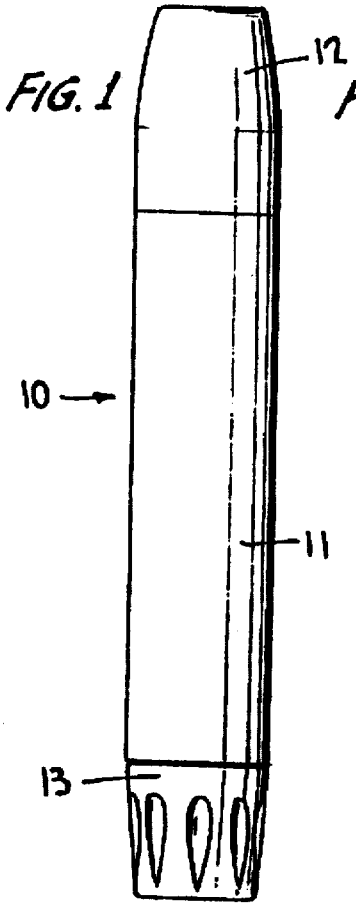
FIG. 1 is a front elevational view of the dispenser of the present invention showing the cap at the top of the body and the knob at the bottom thereof.

Referring now to FIG. 1, the dispenser 10 includes a body 11, a cap 12, and a knob 13.

The body 11 is a hollow cylinder or tube on the inner walls of which are a plurality of the splines 14 which extend axially from the bottom of the tube to the top thereof.

At the top of the tube a portion 15 of reduced outer diameter has a peripheral rib 16 thereon, which engages a peripheral groove 17 at the bottom of the cap 12. This provides a protective closure for the top of the container.

The bottom of the tube 11 includes a ring 18 of smaller diameter than the inner diameter of the tube 11, and the knob 13 includes a groove 19 which fits within the bottom of the cylinder 11 and engages the ring 18 in the groove 19. This permits the knob to turn freely but prevents it from moving axially within or with respect to the tube 11.

Figure 2:
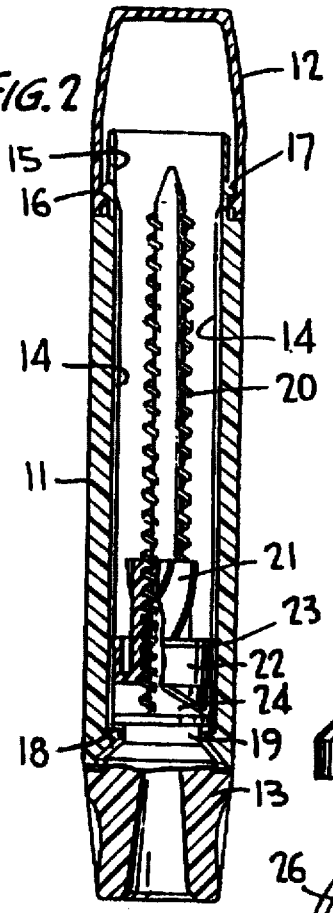
FIG. 2 is a vertical cross-sectional view of the dispenser of FIG. 1 illustrating the screw which is attached to the knob being disposed within the hollow body and with the elevator mounted upon the screw.

A screw 20 formed integrally with the knob 13 extends above the groove 19 into the interior of the tube 11 as can be seen particularly in FIG. 2.

An elevator 21 having female threads which match the male threads of the screw 20 fits within the tube 11 at the bottom of the screw and provides a cup-like portion 22. The upper edges which may contain a bead or rib 23 are pressed against the inner side walls of the tube 11 and the ribs 14 to create a tight-sliding fit. The elevator is made of polyethylene, and the tube is made of polypropylene, and thus when the knob 13 rotates and causes the screw 20 to turn, it causes the elevator 21 to move upwardly within the tube 11 and the polyethylene of the elevator creates a smooth-sliding tight fit between the bead 23 and the inner sidewalls of the tube.

Figure 3:
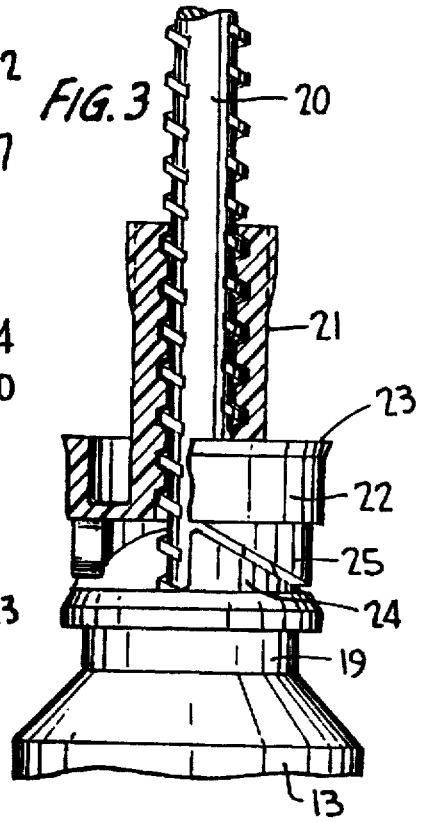
FIG. 3 is an enlarged view of the bottom of the screw-end-knob with the screw extending upwardly therefrom, and with the elevator disposed on the screw at the bottom of the screw.
Figure 7:
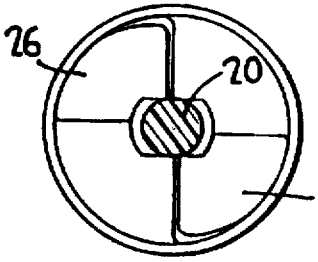
FIG. 7 is a top view of the screw taken along 7—7 of FIG. 4.
Figure 5:
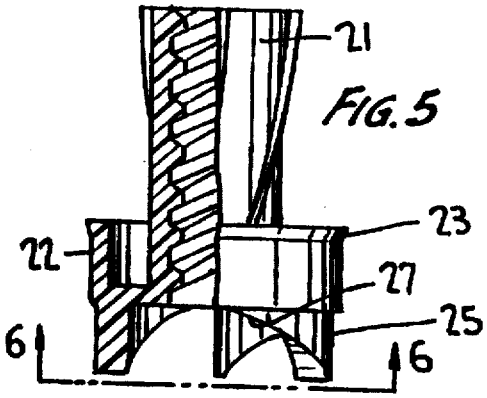
FIG. 5 is a vertical cross-sectional view of the elevator shown previously in FIG. 3.
Figure 6:
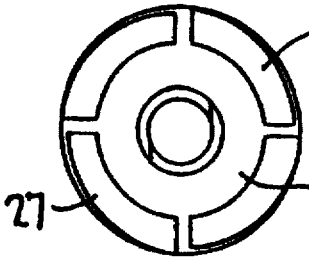
FIG. 6 is a bottom view of the elevator taken along line 6—6 of FIG. 5.
Figure 4:
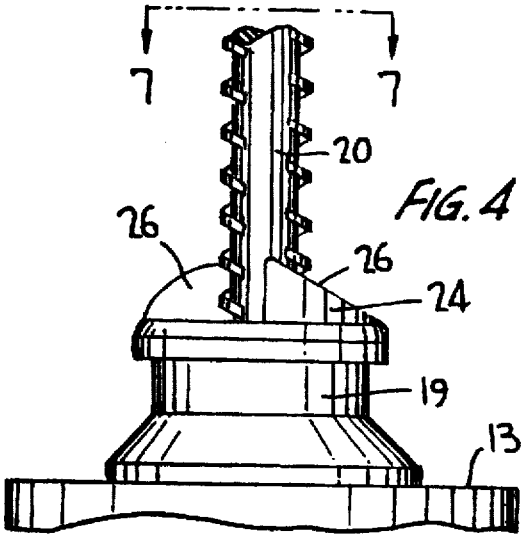
FIG. 4 is a view similar to FIG. 3 but showing only the knob and the bottom portion of the screw, and the "kicker" arrangement formed at the top of the knob and the bottom of the screw.

Referring now particularly to FIGS. 3, 4 and 5, it can be seen that on the knob 13 slightly above the groove 19, one or more "kickers" or "pushers" 24 are formed integrally with the knob at the base of the screw 20. Also formed integrally with the elevator 21 are one or more feet 25, which are shaped to engage with the "kickers" 24.

To accomplish this, it can be seen with FIGS. 3 and 4 that the upper surface 26 of the "kickers" 24 are inclined, and it is the inclined surface 26 which comes into contact with the lower edges of the feet 25.

The feet 25 are more clearly shown in FIG. 5 as a part of the elevator 21, as well as more clearly can be seen the beads 23 which contact the sidewall of the tube 11.

Because the-hot-poured, semi-solid contents of the tube quite often stick to the inner sidewalls of the tube 11, in order to break the material free of the sidewalls, a force greater than the force generally produced by the interaction of the screw and the elevator is needed. This can be provided by the "kickers" 24, inasmuch as when the knob 13 is turned, the surface 26 of the "kickers" push up against the bottom 27 of the feet 25 on the elevator in a direct forceful manner. Because the angle of the surfaces 26 of the "kickers" 24 and the angle of the bottom 27 of the feet 25 are the same as the pitch angle of the threads on the screw 20, the screw 20 and the "kickers" 24 cause the elevator to move the contents upwardly and propel them outwardly through the top of the cylinder 11 under the full force of the "kickers" which prevents the elevator from jumping the threads on the screw.

Thus it can be seen that I have provided an arrangement for dispensing semi-solid material from a relatively small diameter tube by a quick and forceful pressure against the material to break it loose from the sidewalls to which it has adhered after the hot-pouring of the contents into the cylinder.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. In a container for dispensing semi-solid materials such as gel, cream or salve, a tube having an axis and an inner wall, a screw having external threads, an elevator having a bottom and having internal threads mating with the threads on the screw, said screw rotatable within said tube and said elevator mounted on said screw and axially movable within said tube when said screw is rotated, an internal collar at one end of said tube interacting with an external circular groove at one end of said screw, whereby to permit relative rotation between said screw and said tube while preventing relative axial movement therebetween, at least one inclined plane on said screw between said circular groove and said threads on said screw, at least one inclined plane on the bottom of said elevator interacting with the inclined plane on said screw whereby to move said elevator within said tube when said knob is turned and whereby said inclined planes forcibly move the elevator axially within the tube upon initial rotation of the knob, and thereafter said screw moves the elevator along the axis of the tube when the inclined plane on the elevator moves out of contact with the inclined plane on the screw.

2. The container of claim 1 with at least one axial rib on said inner wall and a groove on said elevator to interact with said rib whereby to prevent rotation on said elevator with respect to said tube.

3. The container of claim 1 whereby the angle of the inclined plane on the screw and the inclined plane on the elevator is the same as the angle of the threads on the screw.

4. The container of claim 1 whereby the elevator is initially moved axially within the tube by the interaction between the inclined planes and whereby continued rotation of the screw moves the elevator along the axis of the tube, and the inclined plane on the elevator is no longer in contact with the inclined plane on the screw.

5. The container of claim 3 wherein the initial axial movement of the elevator is caused by the interaction of the planes as well as the interaction between the internal threads on the elevator and the external threads on the screw.

6. The container of claim 4 whereby the axial movement of the elevator within the tube after one full rotation of the screw is caused solely by the interaction between the external threads on the screw and the internal threads on the elevator.

7. The container of claim 1 wherein the pitch on the threads and the inclined planes is between 2 and 12 threads per inch.

8. The container of claim 7 wherein the pitch on the threads and the inclined plane is 4 threads per inch whereby rapidly to move the elevator axially within the tube when the knob is turned.

* * * * *